US009558879B2

(12) United States Patent
Imanishi et al.

(10) Patent No.: US 9,558,879 B2
(45) Date of Patent: Jan. 31, 2017

(54) TEARDROP-SHAPED MAGNETIC CORE AND COIL DEVICE USING SAME

(71) Applicant: SHT Corporation Limited, Izumisano-shi, Osaka (JP)

(72) Inventors: Tsunetsugu Imanishi, Izumisano (JP); Hitoshi Yoshimori, Izumisano (JP)

(73) Assignee: SHT Corporation Limited, Osaka (JP)

( * ) Notice: Subject to any disclaimer, the term of this patent is extended or adjusted under 35 U.S.C. 154(b) by 198 days.

(21) Appl. No.: 14/413,506

(22) PCT Filed: Jun. 26, 2013

(86) PCT No.: PCT/JP2013/067481
§ 371 (c)(1),
(2) Date: Jan. 8, 2015

(87) PCT Pub. No.: WO2014/010416
PCT Pub. Date: Jan. 16, 2014

(65) Prior Publication Data

US 2015/0332837 A1 Nov. 19, 2015

(30) Foreign Application Priority Data

Jul. 13, 2012 (JP) ..... 2012-157425

(51) Int. Cl.
*H01F 17/04* (2006.01)
*H01F 17/06* (2006.01)
(Continued)

(52) U.S. Cl.
CPC ..... *H01F 27/255* (2013.01); *H01F 3/14* (2013.01); *H01F 17/062* (2013.01);
(Continued)

(58) Field of Classification Search
CPC .. H01F 27/255; H01F 27/245; H01F 27/2823; H01F 3/14; H01F 27/346; H01F 17/062; H01F 2027/348
(Continued)

(56) References Cited

U.S. PATENT DOCUMENTS

2004/0172806 A1 9/2004 Yoshimori
2010/0171580 A1 7/2010 Abe et al.

FOREIGN PATENT DOCUMENTS

JP 2003-124015 4/2003
JP 4603728 12/2010
(Continued)

OTHER PUBLICATIONS

International Preliminary Examination Report on Japanese Patent Application No. PCT/JP2013/067481, dated Aug. 26, 2014 (5 pages).
(Continued)

*Primary Examiner* — Elvin G Enad
*Assistant Examiner* — Kazi Hossain
(74) *Attorney, Agent, or Firm* — Buchanan Ingersoll & Rooney PC

(57) ABSTRACT

The present invention provides a teardrop-shaped magnetic core having excellent manufacturing efficiency, a large initial inductance, and stable DC superposition characteristics and a coil device using this teardrop-shaped magnetic core. A teardrop-shaped magnetic core according to the present invention is a magnetic core that is made from a magnetic material and is to be used in a coil device 20, the magnetic core including a first rectilinear portion 11 and a second rectilinear portion 15 that have a straight-line shape and are connected to each other at one end via a bent portion 16 that is bent at a right angle, and a circular arc portion 17 that has a circular arc shape and connects the first rectilinear portion
(Continued)

and the second rectilinear portion to each other at the other end. A coil device according to the present invention is configured by winding a wire around the teardrop-shaped magnetic core 10.

11 Claims, 7 Drawing Sheets

(51) Int. Cl.

| | |
|---|---|
| ***H01F 27/28*** | (2006.01) |
| ***H01F 27/30*** | (2006.01) |
| ***H01F 27/255*** | (2006.01) |
| ***H01F 27/245*** | (2006.01) |
| ***H01F 3/14*** | (2006.01) |
| ***H01F 27/34*** | (2006.01) |

(52) U.S. Cl.
CPC ..... *H01F 27/245* (2013.01); *H01F 27/2823* (2013.01); *H01F 27/346* (2013.01); *H01F 2027/348* (2013.01)

(58) Field of Classification Search
USPC ..... 336/221, 178, 233, 229, 208
See application file for complete search history.

(56) References Cited

FOREIGN PATENT DOCUMENTS

| | | |
|---|---|---|
| JP | 4745543 | 8/2011 |
| JP | 2011-181869 | 9/2011 |
| WO | 03005384 | 1/2003 |
| WO | 2008087885 | 7/2008 |

OTHER PUBLICATIONS

Notification of Transmittal of Translation of the International Preliminary Report on Patentability, and International Preliminary Report on Patentability of Japanese Patent Application No. PCT/JP2013/067481, dated Jan. 15, 2015 (5 pages, English translation).

(a)

(b)

TEARDROP-SHAPED MAGNETIC CORE AND COIL DEVICE USING SAME

TECHNICAL FIELD

The present invention relates to magnetic cores for use in coil devices installed in rectifier circuits, noise preventing circuits, resonant circuits, and the like of AC equipment such as power supply circuits and inverters.

BACKGROUND ART

Coil devices installed in circuits of various types of AC equipment are configured by winding a coil around a ring-shaped magnetic core.

In order to facilitate the winding operation, a coil device is proposed in which a gap portion is formed by cutting away a part of a toroidal magnetic core, which has a circular ring shape, such that the cut-away part has a certain width in the direction of the magnetic path, and a conducting wire is wound around the core while inserting the conducting wire through the gap portion (see FIG. 10 with respect to the conventional technology in Patent Document 1, for example).

In the above-described coil device, the conducting wire needs to be manually wound around the core on a turn-by-turn basis, and thus, the manufacturing efficiency is low.

To address this issue, a coil device 70 is also proposed that is configured by bending a rod-shaped magnetic core into a substantially circular shape including a rectilinear portion 71 as shown in FIG. 14(*a*), and forming a gap portion 74 such that one end surface 72 opposes a side surface 73 of the rectilinear portion 71 (see Patent Documents 1 and 2, for example).

CITATION LIST

Patent Document

[Patent Document 1] Japanese Patent No. 4603728
[Patent Document 2] Japanese Patent No. 4745543

SUMMARY OF INVENTION

Technical Problem

However, in the above-described coil device 70, the end surface 72 that forms the gap portion 74 opposes the side surface 73 of the rectilinear portion 71 that has a larger area than the end surface 72. Accordingly, as shown in FIG. 14(*b*), leakage of the magnetic flux (indicated by the arrows in the diagram) occurs between the end surface 72 and the side surface 73, leading to a decrease in the inductance value. In particular, if the leakage flux avoids the conducting wire 75, the expected inductance that is proportional to the square of the number of turns cannot be exhibited. Moreover, due to an eddy current that is generated by the leakage flux being linked with the conducting wire 75, the so-called copper loss increases, also the magnetic flux deviates from the main magnetic path, and thus an unwanted eddy-current loss occurs in the magnetic core, causing the generation of heat.

Furthermore, the aforementioned Patent Document 2 discloses, in paragraph [0033], a configuration in which the inductance value is increased, the leakage flux is suppressed, and vibration of the magnetic core due to magnetostriction is suppressed by refilling the gap 74 with a magnetic or nonmagnetic gap material.

However, in reality, the most that can be done is to merely suppress vibration of the magnetic core due to magnetostriction, reduce the vibration noise produced by magnetic attraction, and so on by bonding and fixing a nonmagnetic gap material to the gap portion. In particular, refilling with a magnetic gap material requires, for example, control of variations in the magnetic characteristics and the production method, the processing accuracy, and the surface roughness of the magnetic material, and the resultant increase in the manufacturing cost and decrease in the manufacturing efficiency are not easily avoidable. Thus, practical implementation is generally difficult.

Also, a method for increasing the inductance value and suppressing the leakage flux by producing, instead of the nonmagnetic gap material, a magnetic material in which magnetic powder is mixed with an adhesive and applying this magnetic material to the gap portion is known. However, even if the mixing ratio of the magnetic powder is increased until the viscosity of the adhesive mixed with the magnetic powder reaches a value at which a paste is at the limit of operability, the permeability is only a single digit figure of about 2 to 5. For this reason, even though certain effects such as an improvement of the inductance and a reduction of the leakage flux are achieved, the range of application of this method is limited to extremely low magnetic fields, and actually, it is found from the DC superposition characteristics that this method has a disadvantage that the magnetic saturation characteristics deteriorate in cases of high magnetic fields.

An object of the present invention is to provide a teardrop-shaped magnetic core having excellent manufacturing efficiency, a large initial inductance, and stable DC superposition characteristics and a coil device using this teardrop-shaped magnetic core.

Solution to Problem

A teardrop-shaped magnetic core according to the present invention is a magnetic core that is made from a magnetic material and is to be used in a coil device, the magnetic core including:

a first rectilinear portion and a second rectilinear portion that have a straight-line shape and are connected to each other at one end via a bent portion that is bent at a right angle; and a circular arc portion that has a circular arc shape and connects the first rectilinear portion and the second rectilinear portion to each other at the other end.

It is possible that an outer circumferential surface and an inner circumferential surface of the bent portion have a circular arc shape.

It is possible that the first rectilinear portion has a gap portion formed by cutting the first rectilinear portion in a direction perpendicular to a magnetic path, the gap portion including a first end surface that is located on the side of the bent portion and a second end surface that opposes the first end surface and has substantially the same area as the first end surface.

It is possible that a gap-filling magnetic core made from a magnetic material is inserted into the gap portion.

It is desirable that gaps are formed between the gap-filling magnetic core and the first and second end surfaces of the gap portion.

It is possible that the first rectilinear portion, the bent portion, the second rectilinear portion, and the circular arc portion are coated with an electric insulation resin, except for the first end surface and the second end surface of the gap portion.

Moreover, a coil device using the teardrop-shaped magnetic core according to the present invention is configured by winding a wire around the above-described teardrop-shaped magnetic core.

It is possible that the coil device is configured by fitting a previously wound coil onto the teardrop-shaped magnetic core through the gap portion.

Effects of the Invention

The teardrop-shaped magnetic core according to the present invention has the first rectilinear portion and the second rectilinear portion. Thus, during operations for coating circumferential surfaces of the teardrop-shaped magnetic core with the resin, winding the wire, forming the gap portion, and so on, the magnetic core can be easily attached to and positioned relative to an insert molding machine, a winding machine, a jig for winding, and a cutting machine for forming the gap portion. Moreover, displacement of the teardrop-shaped magnetic core during attachment, during positioning, and furthermore, during the aforementioned operations can be suppressed, so that the operations for winding the wire and so on can be efficiently performed.

Also, the teardrop-shaped magnetic core according to the present invention can make the magnetic path substantially uniform throughout the entire magnetic core, because the bent portion has a circular arc shape.

The teardrop-shaped magnetic core according to the present invention can suppress leakage of magnetic flux from the gap portion and can reduce the decrease in the inductance, the eddy-current loss, and the like that are caused by the leakage flux as much as possible, because the first end surface and the second end surface of the gap portion that have substantially the same area oppose each other. Moreover, the gap portion can be formed by cutting the magnetic core that is formed into a teardrop shape, and thus, when compared with a case where a gap portion is formed by bending a rod-shaped magnetic core, the dimensional accuracy can be increased as much as possible.

The teardrop-shaped magnetic core according to the present invention makes it possible to fill the gap portion and obtain desired magnetic characteristics by inserting the gap-filling magnetic core made from a magnetic material into the gap portion. In particular, when gaps are formed between the gap-filling magnetic core and the first and second end surfaces of the gap portion, respectively, even if the gap-filling magnetic core is displaced to some extent within the gap portion, it is possible to disperse the magnitude of the leakage flux while maintaining the inductance value and suppress expansion of the leakage flux distribution.

The teardrop-shaped magnetic core according to the present invention makes it possible to form the gap portion by performing coating with the electric insulation resin in advance before the gap portion is formed and thereafter cutting the first rectilinear portion together with the resin. Thus, the teardrop-shaped magnetic core in which the first rectilinear portion, the bent portion, the second rectilinear portion, and the circular arc portion are coated with the resin and the first end surface and the second end surface, which form the gap portion, are not coated with the resin can be obtained.

In the teardrop-shaped magnetic core according to the present invention, a coating surface on the inner circumferential surface of the second rectilinear portion is continuous with the first surface of the gap portion. Thus, during production of the coil device, a previously wound coil can be fitted onto the circular arc portion and the first rectilinear portion by fitting the previously wound coil onto the second rectilinear portion through the gap portion from the bent portion side and pushing the coil further inward.

DESCRIPTION OF EMBODIMENTS

Hereinafter, an embodiment of a coil device 20 using a teardrop-shaped magnetic core 10 according to the present invention will be described with reference to the drawings.

First Embodiment

In a first embodiment, the coil device 20 that is configured by directly winding a coil 21 around the teardrop-shaped magnetic core 10 according to the present invention will be described.

Figure 1:
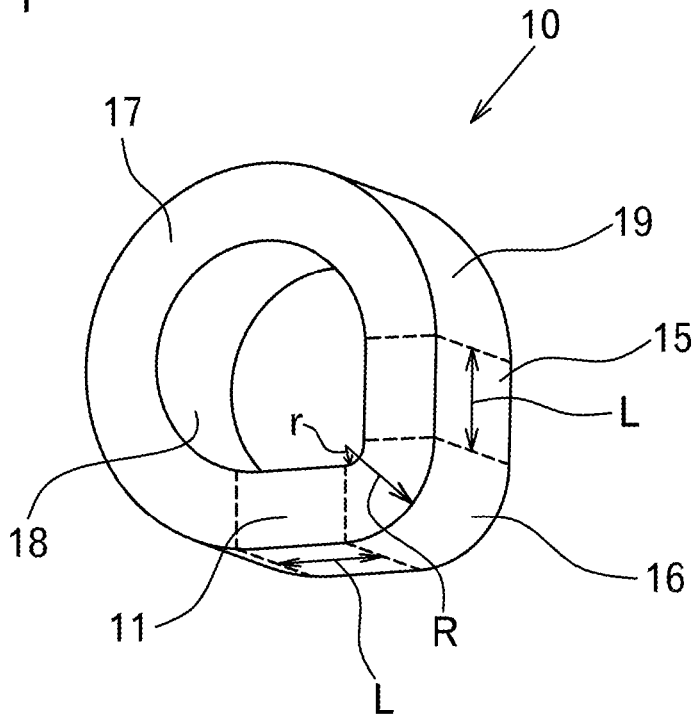
FIG. 1 is a perspective view showing an embodiment of a teardrop-shaped magnetic core of the present invention.

FIG. 1 is a perspective view of the teardrop-shaped magnetic core 10 according to the present invention. The teardrop-shaped magnetic core 10 is made from a magnetic material.

Examples of the magnetic material constituting the teardrop-shaped magnetic core 10 include iron-based, iron—silicon-based, iron—aluminum—silicon-based, and iron— nickel-based materials, iron-based and Co-based amorphous materials, and the like. Laminated cores obtained by laminating or winding thin plates made from the above-described magnetic materials, powder cores obtained by pressure forming power made from the above-described magnetic materials, or ferrite cores obtained by sintering powder made from a magnetic material can be used as the teardrop-shaped magnetic core 10. The teardrop-shaped magnetic core 10 produced by a production method such as those described above has a ring shape, and a gap portion is formed by postprocessing. Therefore, high dimensional accuracy can be achieved when compared with a shape that is obtained by bending a rod-shaped magnetic core.

As shown in FIG. 1, the teardrop-shaped magnetic core 10 includes a first rectilinear portion 11 and a second rectilinear portion 15 that have a straight-line shape and are connected to each other at one end via a bent portion 16 that is bent at substantially right angles, and a circular arc portion 17 that has a circular arc shape and connects the first rectilinear portion 11 and the second rectilinear portion 15 to each other at the other end.

More specifically, as shown in FIG. 1, the first rectilinear portion 11 and the second rectilinear portion 15 are formed to have substantially the same length L, and the bent portion 16, which connects the first rectilinear portion 11 and the second rectilinear portion 15 to each other, is formed such that the circular arc angle is approximately 90° and an inner circumferential surface 18 and an outer circumferential surface 19 have concentric circular arc shapes with respective inner diameters "r" and "R" (where r<R). Moreover, the circular arc portion 17, which connects the other end of the first rectilinear portion 11 and the other end of the second rectilinear portion 15 to each other, is also formed to have concentric circular arc shapes with a circular arc angle of approximately 270°. Thus, the inner circumferential surface 18 and the outer circumferential surface 19 of the magnetic core 10 individually define a teardrop shape. It should be noted that in order to facilitate understanding of the description, in FIG. 1, the boundaries between the first rectilinear portion 11, the bent portion 16, the second rectilinear portion 15, and the circular arc portion 17 are indicated by dashed lines.

It is desirable that the teardrop-shaped magnetic core 10 is formed to have a substantially uniform cross-sectional area at any positions when cut perpendicularly to the inner circumferential surface 18 and the outer circumferential surface 19, and preferably, the cross section has a rectangular shape as shown in the drawings. It should be noted that the cross-sectional shape of the teardrop-shaped magnetic core 10 is not limited to a rectangle and may also be a circle, an ellipse, or the like.

With the above-described configuration in which the teardrop-shaped magnetic core 10 has a substantially uniform cross-sectional area, when the coil device 20 is configured in the manner described later, the area of the main magnetic path can be made substantially uniform, so that stable inductance characteristics can be obtained.

The above-described teardrop-shaped magnetic core 10 is attached to a jig, such as a clamp, which is not shown, and a conducting wire 22 constituting the coil 21 is wound therearound. The jig is capable of fixing the teardrop-shaped magnetic core 10 by holding, for example, the bent portion 16. At this time, the magnetic core 10 has a teardrop shape with the first rectilinear portion 11 and the second rectilinear portion 15 individually having a straight-line shape, and therefore can be easily positioned relative to the jig.

Figure 2:
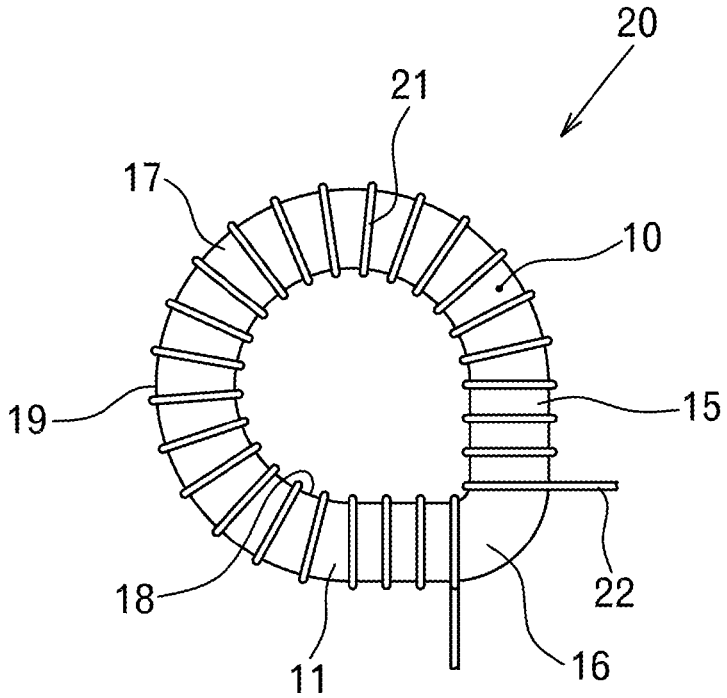
FIG. 2 is a plan view of a coil device configured by directly winding a coil around the teardrop-shaped magnetic core in FIG. 1.

The conducting wire 22 is wound around the teardrop-shaped magnetic core 10 manually or by a winding machine and constitutes the coil 21, and thus, the coil device 20 is produced as shown in FIG. 2.

Figure 3:
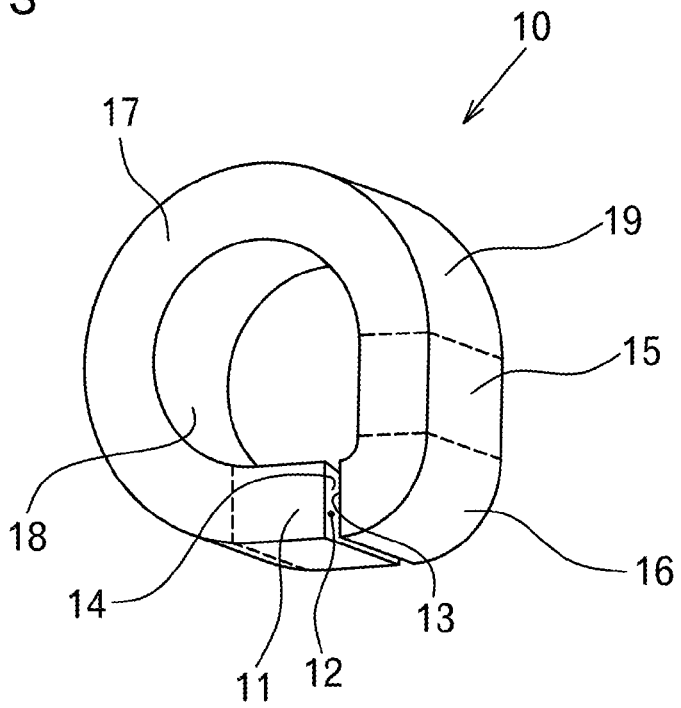
FIG. 3 is a perspective view showing an embodiment of the teardrop-shaped magnetic core of the present invention in which a gap portion is formed.

During winding of the wire, the above-described configuration provides virtually no option but to resort to manual operations, resulting in low manufacturing efficiency of the coil device 20. To address this issue, as shown in FIG. 3, a part of the teardrop-shaped magnetic core 10 in FIG. 1 is cut to form a gap portion 12, and the conducting wire 22 is wound while being inserted through the gap portion 12. In this manner, the manufacturing efficiency can be increased.

Figure 4:
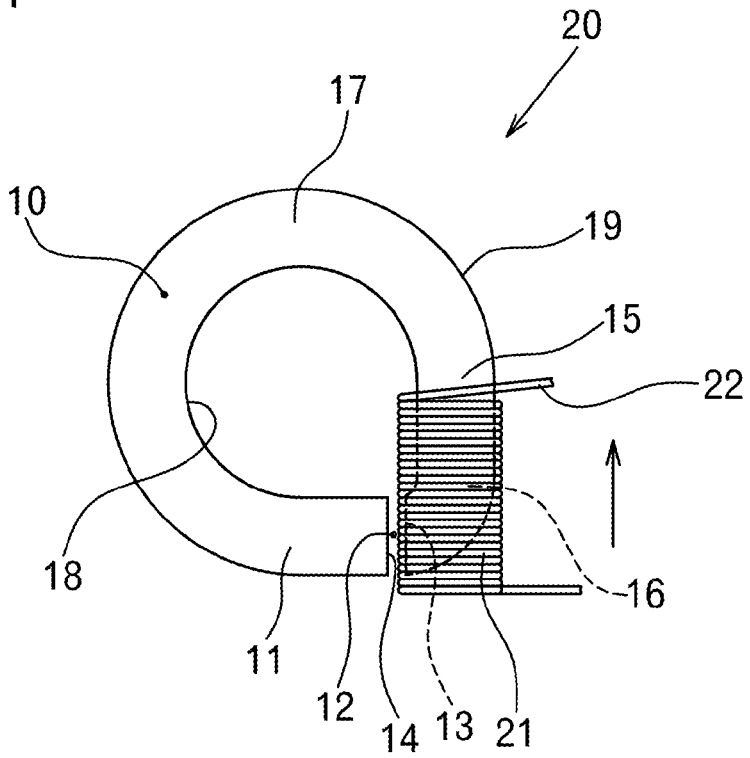
FIG. 4 is a plan view showing a process of fitting a previously wound coil onto the teardrop-shaped magnetic core in FIG. 3.

Furthermore, as shown in FIG. 4, it is also possible to increase the manufacturing efficiency as much as possible by inserting the coil 21 (a so-called air-core coil) formed by winding the conducting wire 22 in advance through the gap portion 12.

The gap portion 12 can be formed by, for example, cutting away a portion of the first rectilinear portion 11 substantially perpendicularly thereto, the cut-away portion extending from the boundary (indicated by the dashed lines in FIG. 1) between the bent portion 16 and the first rectilinear portion 11 to the side of the first rectilinear portion 11 and having a desired width. Here, an end surface of the gap portion 12 that is located on the side of that boundary is referred to as a first end surface 13, and a surface that is opposite to the first end surface 13 is referred to as a second end surface 14. The first end surface 13 is formed to protrude farther than the inner circumferential surface 18 of the second rectilinear portion 15 by a distance corresponding to the radius of curvature "r" of the inner circumferential surface 18 of the bent portion 16, and is not coplanar with the inner circumferential surface 18 of the second rectilinear portion 15. Moreover, the first end surface 13 and the second end surface 14 oppose each other while having the same area because the first rectilinear portion 11 is cut rather than a curved portion. Thus, when compared with a case where these end surfaces are formed in a curved portion, leakage flux concentrating on a short distance from the magnetic path can be avoided, and an eddy-current loss caused by this leakage flux can also be reduced.

In addition, at the gap portion 12, the areas of the first end surface 13 and the second end surface 14 are the same as the vertical cross-sectional area of the first rectilinear portion 11. Thus, leakage of the magnetic flux between the end surfaces 13 and 14 is accurate with respect to the direction of the magnetic path and stable.

The teardrop-shaped magnetic core 10 is cut at the first rectilinear portion 11. Thus, when compared with a case where the magnetic core is cut at a curved portion, misalignment of a grindstone and a cutting blade can be suppressed, and the gap portion 12 is formed easily and accurately.

Figure 5:
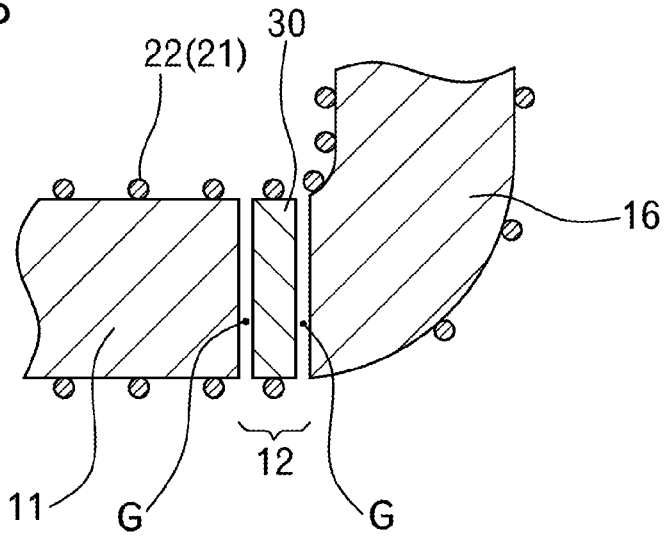
FIG. 5 is a partial cross-sectional view of the coil device in which a gap-filling magnetic core is inserted in the gap portion.

As shown in FIG. 5, a gap-filling magnetic core 30 made from a magnetic material can be inserted into the gap portion 12.

The gap-filling magnetic core 30 is made from a magnetic material such as iron-based, iron—silicon-based, iron—aluminum—silicon-based, and iron—nickel-based materials, iron-based and Co-based amorphous materials, and the like. By way of example, laminated cores formed by laminating or winding thin plates made from the above-described magnetic materials, powder cores formed by pressure forming powder made from the above-described magnetic materials, or ferrite cores formed by sintering powder made from a magnetic material can be used as the gap-filling magnetic core 30. If a laminated core is used, it is desirable to form the laminated core into a block by crimping the thin plates that are formed into a desired shape by stamping, or by welding an end surface of the thin plates.

It is possible to fill the gap portion 12 and obtain desired magnetic characteristics by inserting the gap-filling magnetic core 30 into the gap portion 12. In particular, when the gap-filling magnetic core 30 is inserted such that gaps G are formed between the gap-filling magnetic core 30 and the first and second end surfaces 13 and 14 of the gap portion 12, respectively, even if the gap-filling magnetic core 30 is displaced to some extent within the gap portion 12, it is possible to disperse the magnitude of the leakage flux while maintaining the inductance value and suppress expansion of the leakage flux distribution.

Since the expansion of the leakage flux at the gap portion 12 can be suppressed by inserting the gap-filling magnetic core 30 into the gap portion 12, the coil 21 can be tightly wound so as to overlap the gap-filling magnetic core 30. Thus, the inductance can be increased while suppressing the effect of the copper loss due to an eddy current.

It should be noted that the gap-filling magnetic core 30 is not limited to the above-described configuration. Even though the performance and the manufacturing efficiency decrease, it is also possible to fill the gap portion 12 with a paste prepared by mixing a magnetic material with an adhesive so as to secure the inductance at an extremely low magnetic field and also obtain other desired characteristics.

According to the present invention, the teardrop-shaped magnetic core 10 is provided with the first rectilinear portion 11 and the second rectilinear portion 15 as described above. Therefore, when compared with a toroidal magnetic core having an equal diameter, the magnetic path length can be increased by about 5%, and also the window area can be increased by about 5%. Accordingly, the inductance value can be enhanced by about 14%.

Second Embodiment

Figure 6:
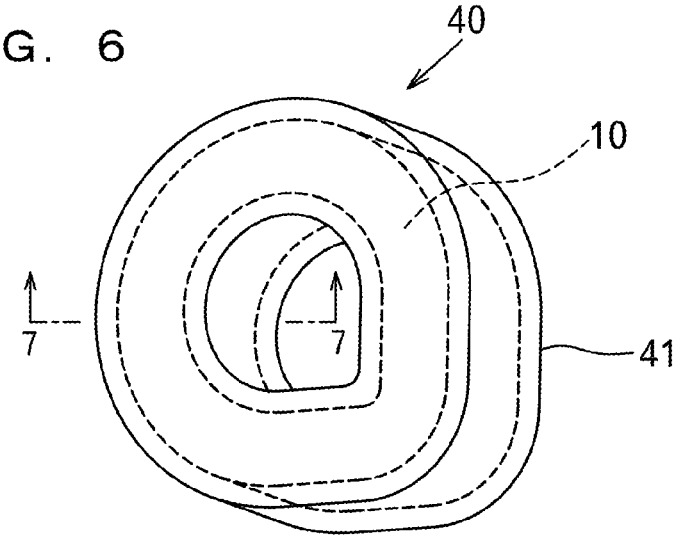
FIG. 6 is a perspective view of a coated magnetic core obtained by coating the teardrop-shaped magnetic core shown in FIG. 1 with an insulating resin.
Figure 7:
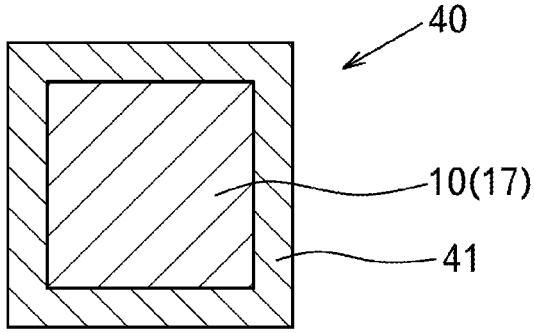
FIG. 7 is a cross-sectional view taken along line 7-7 in FIG. 6.

In a second embodiment, the coil device 20 that is configured by winding the coil 21 around a coated magnetic core 40 obtained by coating the teardrop-shaped magnetic core 10, which is described in the first embodiment using FIG. 1, with an electric insulation resin 41 as shown in FIG. 6 and FIG. 7, which is a cross-sectional view of the magnetic core in FIG. 6, will be described. It should be noted that the descriptions of the same portions as those of the first embodiment are omitted as appropriate.

Coating of the teardrop-shaped magnetic core 10 with resin can be performed by insert molding. At this time, the teardrop-shaped magnetic core 10 is provided with the first rectilinear portion 11 and the second rectilinear portion 15 and thus can be easily positioned and fixed by applying positioning pins within an insert molding machine to the rectilinear portions 11 and 15.

Moreover, it is also possible to form the coated magnetic core 40 by performing coating with resin by producing half-bodies of a case made of resin in advance and putting the pair of half-bodies of the case on the teardrop-shaped magnetic core 10.

The above-described coated magnetic core 40 is attached to a jig, such as a clamp, which is not shown, and the conducting wire 22 constituting the coil 21 is wound therearound. The jig is capable of fixing the coated magnetic core 40 by holding, for example, the side of the bent portion 16. At this time, the coated magnetic core 40 has a teardrop shape and the rectilinear portions, and thus can be easily positioned relative to the jig.

Figure 8:
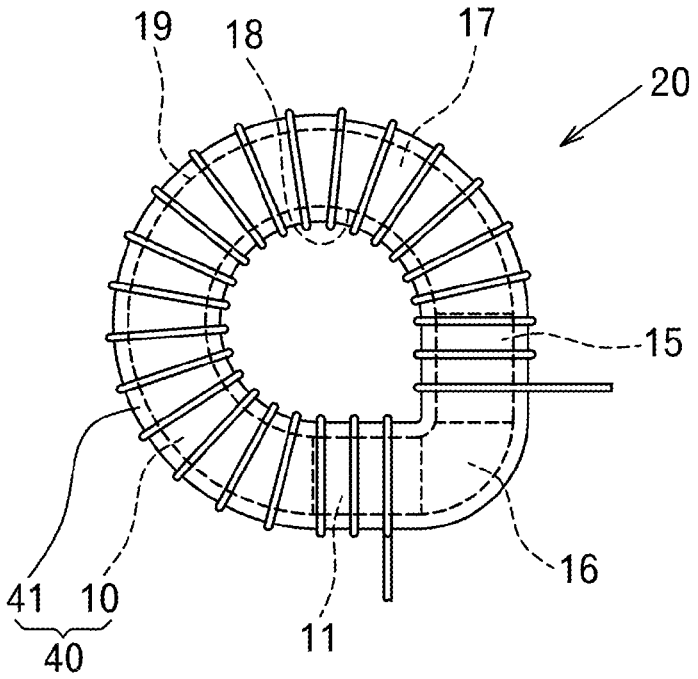
FIG. 8 is a plan view of a coil device configured by directly winding a coil around the coated magnetic core in FIG. 6.

The conducting wire 22 is wound around the coated magnetic core 40 manually or by a winding machine and constitutes the coil 21, and thus, the coil device 20 is produced as shown in FIG. 8.

Figure 11:
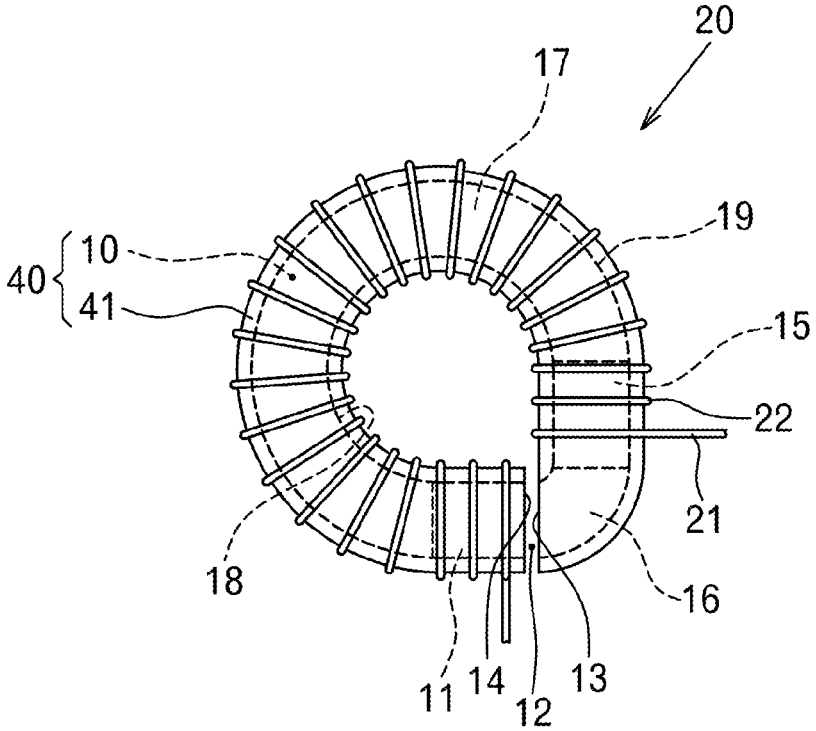
FIG. 11 is a plan view of a coil device that is produced by the process shown in FIG. 10.

Moreover, as shown in FIG. 7, the manufacturing efficiency of the coil device 20 (see FIG. 11) can be increased by cutting a part of the coated magnetic core 40 shown in FIG. 6 to form the gap portion 12 and winding the conducting wire 22 while inserting it through the gap portion 12.

Figure 10:
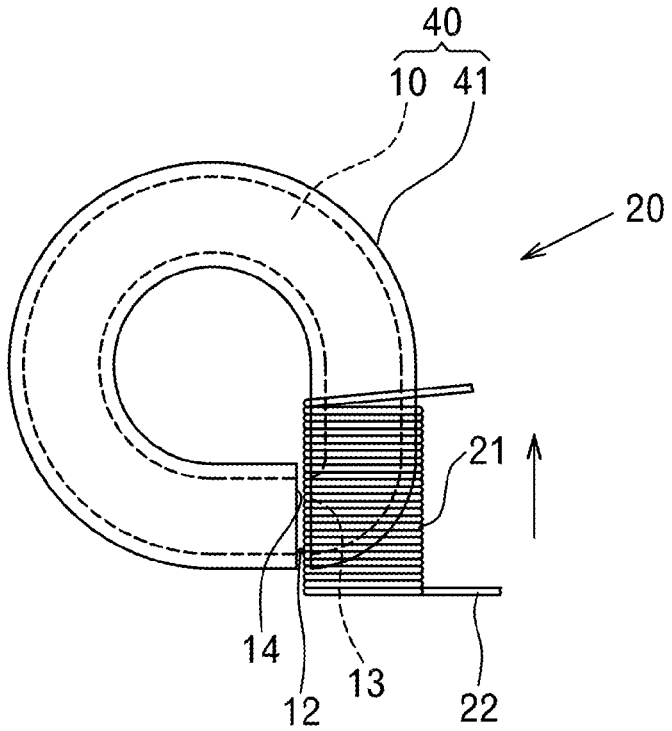
FIG. 10 is a plan view showing a process of fitting a previously wound coil onto the coated magnetic core in FIG. 9.

Furthermore, as shown in FIG. 10, the coil device 20 (see FIG. 11) can also be produced by inserting the coil 21 (a so-called air-core coil) formed by winding the conducting wire 22 in advance through the gap portion 12. In this manner, the manufacturing efficiency of the coil device 20 can be increased as much as possible.

The gap portion 12 can be formed by, for example, cutting away a portion of the first rectilinear portion 11 substantially perpendicularly thereto, the cut-away portion extending from the boundary (indicated by the dashed lines in FIG. 1) between the bent portion 16 and the first rectilinear portion 11 of the teardrop-shaped magnetic core 10 to the side of the first rectilinear portion 11 and having a desired width. Here, the end surface of the gap portion 12 that is located on the side of that boundary is referred to as the first end surface 13, and the surface that is opposite to the first end surface 13 is referred to as the second end surface 14. The first end surface 13 is formed to protrude farther than the inner circumferential surface 18 of the second rectilinear portion 15 by a distance corresponding to the radius of curvature "r" of the inner circumferential surface of the bent portion 16 and is not coplanar with the inner circumferential surface 18 of the second rectilinear portion 15. Moreover, the first end surface 13 and the second end surface 14 oppose each other while having the same area because the first rectilinear portion 11 is cut rather than a curved portion. Thus, leakage of magnetic flux can be suppressed, and the eddy-current loss caused by the leakage of magnetic flux can be reduced.

The coated magnetic core 40 in which the first rectilinear portion 11, the bent portion 16, the second rectilinear portion 15, and the circular arc portion 17 are coated with resin except for the first end surface 13 and the second end surface 14 of the gap portion 12 can be produced by performing coating with resin before forming the gap portion 12 by cutting the teardrop-shaped magnetic core 10.

Moreover, at the gap portion 12, the areas of the first end surface 13 and the second end surface 14 are the same as the vertical cross-sectional area of the first rectilinear portion 11. Thus, leakage of magnetic flux between the end surfaces 13 and 14 hardly occurs.

The coated magnetic core 40 is cut at the rectilinear portion. Thus, when compared with a case where the magnetic core is cut at a curved portion, misalignment of a grindstone and a cutting blade can be suppressed, and the gap portion 12 is easily and accurately formed.

Figure 9:
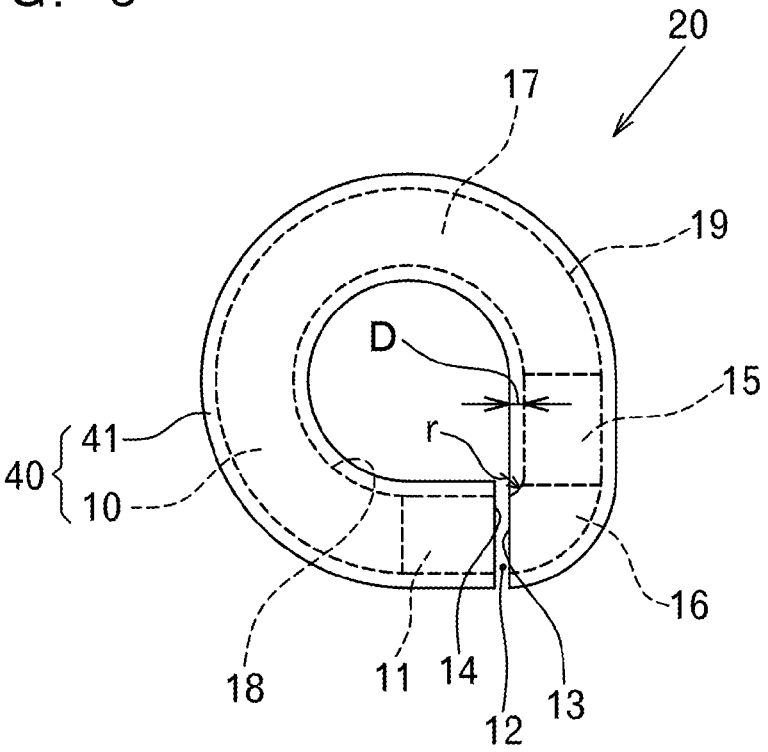
FIG. 9 is a perspective view of the coated magnetic core in which a gap portion is formed.

In the case where the gap portion 12 is formed in the coated magnetic core 40 as described above and the air-core coil 21 is inserted, in order to facilitate insertion of the air-core coil 21 by eliminating any step between the first end surface 13 of the gap portion 12 and a resin-coated inner surface of the second rectilinear portion 15, it is desirable to set the thickness D of the applied resin 41 to be substantially equal to the radius of curvature "r" of the inner circumferential surface of the bent portion 16, that is, the distance by which the first end surface 13 protrudes farther than the second rectilinear portion 15, as shown in FIG. 9.

Figure 12:
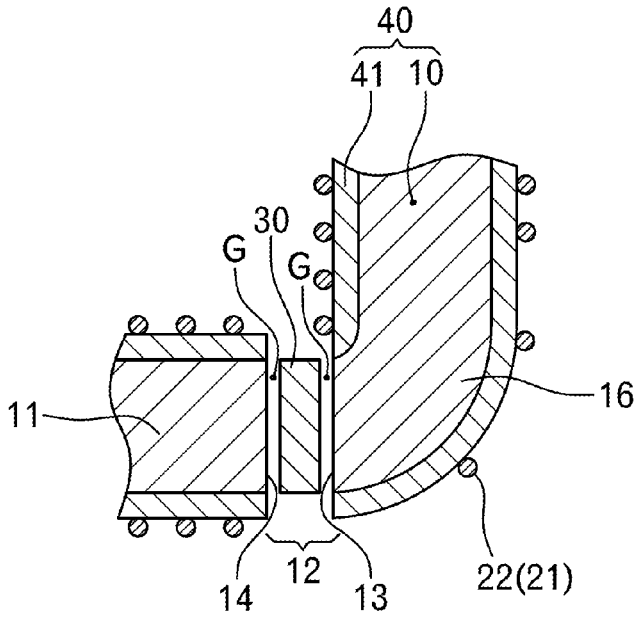
FIG. 12 is a partial cross-sectional view of the coil device in which a gap-filling magnetic core is inserted in the gap portion.

Moreover, as shown in FIG. 12, the gap-filling magnetic core 30 made from a magnetic material can be inserted into the gap portion 12. The details of the gap-filling magnetic core 30 are described in the first embodiment.

The insertion of the gap-filling magnetic core 30 into the gap portion 12 makes it possible to fill the gap portion 12 and obtain desired magnetic characteristics. In particular, when the gap-filling magnetic core 30 is inserted such that the gaps G are formed between the gap-filling magnetic core 30 and the first and second end surfaces 13 and 14 of the gap portion 12, respectively, even if the gap-filling magnetic core 30 is displaced to some extent within the gap portion 12, it is possible to disperse the magnitude of the leakage flux while maintaining the inductance value and suppress expansion of the leakage flux distribution.

Moreover, since the expansion of the leakage flux at the gap portion 12 can be suppressed by inserting the gap-filling magnetic core 30 into the gap portion 12, the coil 21 can be tightly wound so as to overlap the gap-filling magnetic core 30. Thus, the inductance can be increased while suppressing the effect of the copper loss due to an eddy current.

It should be noted that the gap-filling magnetic core 30 is not limited to the above-described configuration. Even though the performance and the manufacturing efficiency decrease, the gap portion 12 may also be filled with a paste prepared by mixing a magnetic material with an adhesive.

According to the present invention, the teardrop-shaped magnetic core 10 is provided with the first rectilinear portion 11 and the second rectilinear portion 15 as described above. Thus, when compared with a toroidal magnetic core having an equal diameter, the magnetic path length of the coated magnetic core 40 can be increased by about 5%, and also the window area thereof can be increased by about 5%. Accordingly, the inductance value can be enhanced by about 14%.

According to the above-described first and second embodiments, the gap portion 12 is formed in the first rectilinear portion 11. However, it goes without saying that the gap portion may be formed in the second rectilinear portion 15.

EXAMPLES

With respect to coil devices 20 (Examples 1 to 3) according to the above-described second embodiment, a comparison of the DC superposition characteristics was performed.

The teardrop-shaped magnetic core 10 was formed to have the following dimensions: length L of the first rectilinear portion 11 and the second rectilinear portion 15, 7.1 mm; thickness, that is, distance between the inner circumferential surface 18 and the outer circumferential surface 19, 4.75 mm; radius of curvature "r" of the inner circumferential surface 18 of the bent portion 16, 1.2 mm; radius of curvature R of the outer circumferential surface 19 of the bent portion 16, 6 mm; height, 15 mm; and diameter of the circular arc portion 17, 23.7 mm. Also, the teardrop-shaped magnetic core 10 was formed by rolling grain-oriented silicon-steel sheets into a teardrop shape and fixing an end portion of rolling by welding.

The above-described teardrop-shaped magnetic core 10 was coated with the insulating resin 41 having a thickness of 1.2 mm, and the gap portion 12 having a width of 2 mm was formed. In Examples 2 and 3, the gap-filling magnetic core 30 described below was filled or inserted into the gap portion 12.

In Example 1, the gap portion 12 was not refilled.

In Example 2, the gap portion 12 was refilled with an adhesive in the form of a high-viscosity paste prepared by mixing powder of a magnetic material in which Sendust powder (composition: Fe—Al—Si) was used and a single-component epoxy adhesive at a weight ratio of 80:20.

In Example 3, a non-oriented silicon steel sheet having a thickness of 0.2 mm was used. Laminations were stamped from the sheet and stacked, and an end surface portion was fixed by welding to form the stack of laminations into a block. The thus obtained gap-filling magnetic core 30 having a width of 1 mm was inserted into the gap portion 12. Gaps G of 0.5 mm were formed between the gap-filling magnetic core 30 and the first and second end surfaces 13 and 14, respectively.

Figure 13:
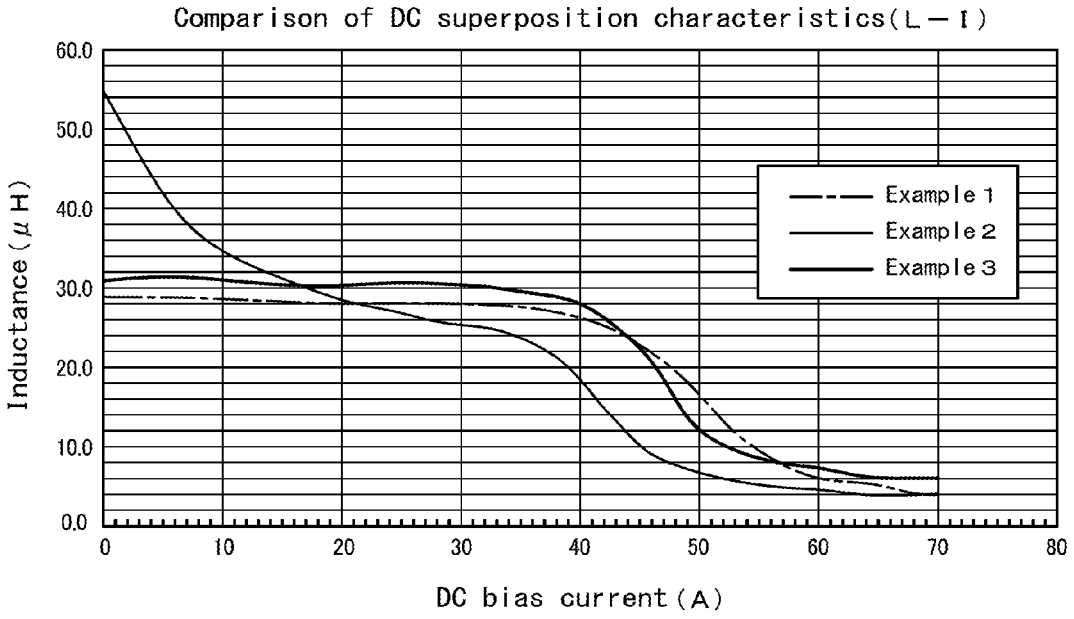
FIG. 13 is a graph showing DC superposition characteristics of examples.
Figure 14:
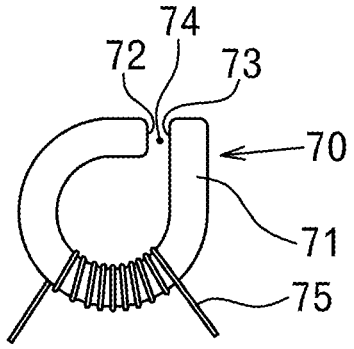
FIG. 14(*a*) is a plan view of a coil device that is described in the Background Art section, and FIG. 14(*b*) is a partial enlarged view of a gap portion.
Figure 14:
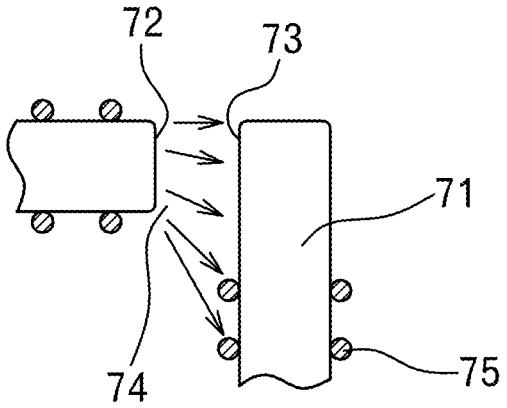

With respect to Examples 1 to 3 described above, a DC bias current was applied, and a comparison of the DC superposition characteristics was performed. FIG. 13 shows the results.

Referring to FIG. 13, it can be seen that although the inductance value of Example 1 is lower than that of Example 3, the magnetic saturation characteristics of Example 1 are stable.

Also, with respect to Example 2, the initial inductance value can be increased when compared with those of Examples 1 and 3. On the other hand, it can be seen that the rate at which the inductance value decreases with an increase in the magnitude of the DC bias current is high.

With respect to Example 3, it can be seen that the magnetic saturation characteristics of Example 3 are superior to those of Example 1, and the insertion of the gap-filling magnetic core 30, which was obtained by stacking the laminations of the non-oriented silicon steel sheet and forming the stack into a block, into the gap portion 12 made it possible to positively form a minute air gap and stabilize the magnetic characteristics without relying on the dimensional accuracy of the finished magnetic core. Thus, the gap portion 12 can be adjusted by changing the dimensions of the gap-filling magnetic core 30, and desired magnetic characteristics can be easily secured at low cost.

Moreover, the insertion of the gap-filling magnetic core 30 can improve the inductance value. Furthermore, the first end surface 13 and the second end surface 14 that are formed in the rectilinear portion allow the leakage flux concentrating on a short distance from the magnetic path to be avoided and the inductance to be efficiently improved.

It should be noted that with respect to Example 3, the gap-filling magnetic core 30 inserted into the gap portion 12 forms the two gaps G having substantially the same width at both surfaces that are at right angles to a direction in which the main magnetic flux passes. With regard to these gaps G, when a coil device 20 in which the position of the gap-filling magnetic core 30 was slightly shifted from the center was produced, and the DC superposition characteristics of the coil device 20 were measured in the same manner as described above, variations in the leakage flux were suppressed while maintaining the inductance value. Therefore, it is found that the coil device 20 of Example 3 is a highly practical coil device that can allow an error in attachment accuracy of the gap-filling magnetic core 30 during assembly.

INDUSTRIAL APPLICABILITY

The present invention is useful as a teardrop-shaped magnetic core having excellent manufacturing efficiency, a large initial inductance, and stable DC superposition characteristics and a coil device using this teardrop-shaped magnetic core.

LIST OF REFERENCE NUMERALS

10 Teardrop-shaped magnetic core
11 First rectilinear portion

12 Gap portion
13 First end surface
14 Second end surface
15 Second rectilinear portion
16 Bent portion
17 Circular arc portion
20 Coil device
30 Gap-filling magnetic core
40 Coated magnetic core

The invention claimed is:

1. A teardrop-shaped magnetic core that is made from a magnetic material and is to be used in a coil device, the magnetic core comprising:

a first rectilinear portion and a second rectilinear portion that have a straight-line shape and are connected to each other at one end via a bent portion that is bent at a right angle; and a circular arc portion that has a circular arc shape and connects the first rectilinear portion and the second rectilinear portion to each other at the other end, wherein an outer circumferential surface and an inner circumferential surface of the bent portion have concentric circular arc shapes, the bent portion, the first rectilinear portion, the second rectilinear portion, and the circular arc portion are coated with an electric insulation resin, the resin with which an inner circumferential surface of the second rectilinear portion is coated having a thickness that is substantially equal to a radius of curvature of the inner circumferential surface of the bent portion, and the first rectilinear portion has a gap portion formed by cutting the first rectilinear portion in a direction perpendicular to a magnetic path, and no step is present between a first end surface of the gap portion that is located on the side of the bent portion and a resin-coated inner surface of the second rectilinear portion.

2. The teardrop-shaped magnetic core according to claim 1, wherein the gap portion of the first rectilinear portion includes a second end surface that opposes the first end surface and has substantially the same area as the first end surface.

3. The teardrop-shaped magnetic core according to claim 1, wherein a gap-filling magnetic core made from a magnetic material is inserted into the gap portion.

4. The teardrop-shaped magnetic core according to claim 2, wherein a gap-filling magnetic core made from a magnetic material is inserted into the gap portion.

5. The teardrop-shaped magnetic core according to claim 3, wherein gaps are formed between the gap-filling magnetic core and the first and second end surfaces of the gap portion.

6. The teardrop-shaped magnetic core according to claim 4, wherein gaps are formed between the gap-filling magnetic core and the first and second end surfaces of the gap portion.

7. The teardrop-shaped magnetic core according to claim 3, wherein the gap-filling magnetic core is a laminated core, a powder core, or a sintered core.

8. The teardrop-shaped magnetic core according to claim 4, wherein the gap-filling magnetic core is a laminated core, a powder core, or a sintered core.

9. The teardrop-shaped magnetic core according to claim 1, wherein the first rectilinear portion, the bent portion, the second rectilinear portion, and the circular arc portion are constituted by a laminated core, a powder core, or a sintered core.

10. A coil device that is configured by winding a wire around the teardrop-shaped magnetic core according to claim 1.

11. A coil device that is configured by fitting a previously wound coil onto the teardrop-shaped magnetic core according to claim 1 through the gap portion.

* * * * *